US009419365B2

(12) United States Patent
Wu et al.

(10) Patent No.: US 9,419,365 B2
(45) Date of Patent: Aug. 16, 2016

(54) CABLE CONNECTOR ASSEMBLY HAVING AN IMPROVED SPACER

(71) Applicant: HON HAI PRECISION INDUSTRY CO., LTD., New Taipei (TW)

(72) Inventors: Jerry Wu, Irvine, CA (US); Jun Chen, Kunshan (CN); Zhan-Feng Song, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/458,544

(22) Filed: Aug. 13, 2014

(65) Prior Publication Data

US 2015/0050836 A1 Feb. 19, 2015

(30) Foreign Application Priority Data

Aug. 14, 2013 (CN) ..... 2013 2 0492806 U

(51) Int. Cl.
*H01R 24/00* (2011.01)
*H01R 13/436* (2006.01)
*H01R 24/60* (2011.01)

(52) U.S. Cl.
CPC ..... *H01R 13/4367* (2013.01); *H01R 24/60* (2013.01)

(58) Field of Classification Search
CPC ..... H01R 13/447; H01R 13/506; H01R 13/6461; H01R 13/6463; H01R 13/648; H01R 13/652; H01R 13/655; H01R 13/6581; H01R 13/6585; H01R 13/6586; H01R 13/659; H01R 13/6593; H01R 13/66
USPC ..... 439/660, 494, 497, 499, 874
See application file for complete search history.

(56) References Cited

U.S. PATENT DOCUMENTS 5,073,126 A * 12/1991 Kikuchi ..... H01R 4/245 439/397
6,007,366 A * 12/1999 Torii ..... H01R 4/2429 439/397
6,685,507 B2 * 2/2004 Piovesan ..... H01R 13/501 439/596
7,011,543 B2 * 3/2006 Hiramoto et al. ..... 439/405
7,462,065 B1 * 12/2008 Zhao ..... H01R 12/592 439/497
7,695,318 B1 4/2010 Wang et al.
7,824,198 B2 * 11/2010 Tanaka ..... H01R 9/034 439/108
8,858,254 B2 * 10/2014 Ikari ..... H01R 12/592 439/492

* cited by examiner

*Primary Examiner* — Amy Cohen Johnson
*Assistant Examiner* — Milagros Jeancharles
(74) *Attorney, Agent, or Firm* — Ming Chieh Chang; Wei Te Chung

(57) ABSTRACT

A cable connector assembly includes an insulative housing (1) defining a cavity (1150), a number of contacts (2,3) retained in the insulative housing, a cable (6) electrically connected with the contacts, a spacer (4) assembled to the back end of the insulative housing, and a metallic shell (5) enclosing the insulative housing. The contacts comprise a number of first and second contacts each having a contacting portion and a tail portion, the tail portions extending beyond a back end of the insulative housing. The spacer has a plurality of grooves (42,43) for receiving tail portions of the contacts and a separator disposed between every two neighboring grooves. The separator is T-shaped in order to restrain the contact tail portion.

3 Claims, 6 Drawing Sheets

CABLE CONNECTOR ASSEMBLY HAVING AN IMPROVED SPACER

BACKGROUND OF THE INVENTION

1. Field of the Invention

The present invention relates to a cable connector assembly, and more particularly to a cable connector assembly for high speed signal transmission.

2. Description of Related Art

At present, Universal Serial Bus (USB) is a widely used input/output interface adapted for many electronic devices, such as personal computer and related peripherals. In 1994, USB-IF was founded to define a spec of USB. Nowadays, USB-IF has published several editions for USB, and transmission rate of USB has become higher and higher. As development of electronic industry, higher transmitting rate of USB based connection accessory is needed.

U.S. Pat. No. 7,695,318, issued to Wang et al. on Apr. 13, 2010, discloses a cable connector assembly in accordance with USB 3.0 standard. The cable connector assembly comprises an insulative housing, five first contacts for transmitting high speed signal and four second contacts compatible to the version USB 2.0 standard, a spacer assembled to the insulative housing, and a metallic shell enclosing on the insulative housing. Tail portions of the first and second contacts extend beyond a back end of the insulative housing to be supported in grooves of the spacer. The tail portions in the grooves are not positively restrained.

Hence, an improved cable connector assembly with an improved spacer is desired to overcome the above problems.

BRIEF SUMMARY OF THE INVENTION

According to one aspect of the present invention, a cable connector assembly comprises: an insulative housing defining a cavity; a plurality of contacts retained in the insulative housing and comprising a number of first and second contacts, each contact having a contacting portion and a tail portion, the tail portions extending beyond a back end of the insulative housing; a cable electrically connected with the contacts; a spacer assembled to the back end of the insulative housing and having a plurality of grooves for receiving the tail portions of the contacts; and a metallic shell enclosing the insulative housing; wherein a T-shaped separator is disposed between every two neighboring grooves, and the tail portions of the contacts are restrained in corresponding grooves by corresponding separators.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Figure 1:
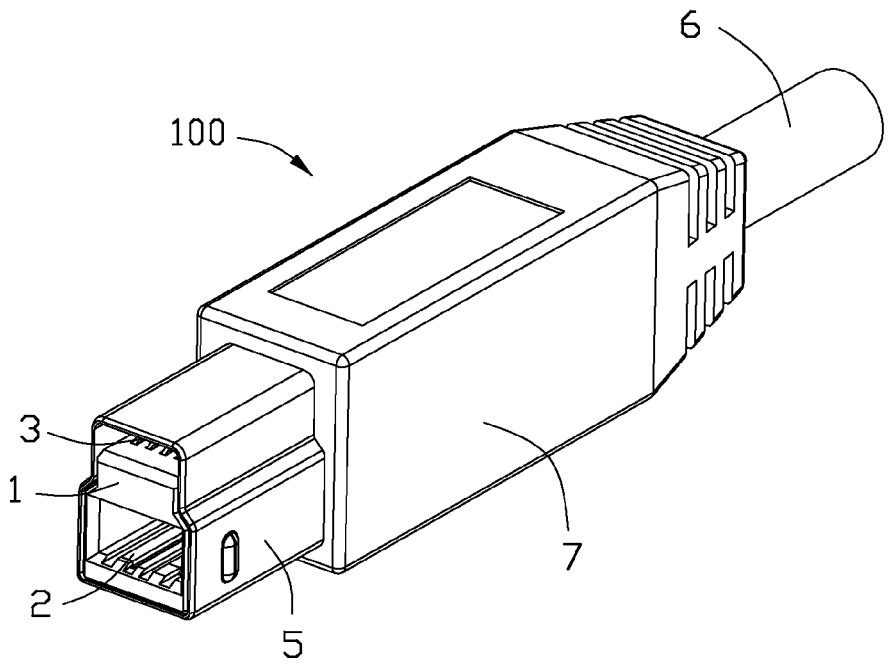
FIG. 1 is an assembled, perspective view of a cable connector assembly according to the present invention.
Figure 2:
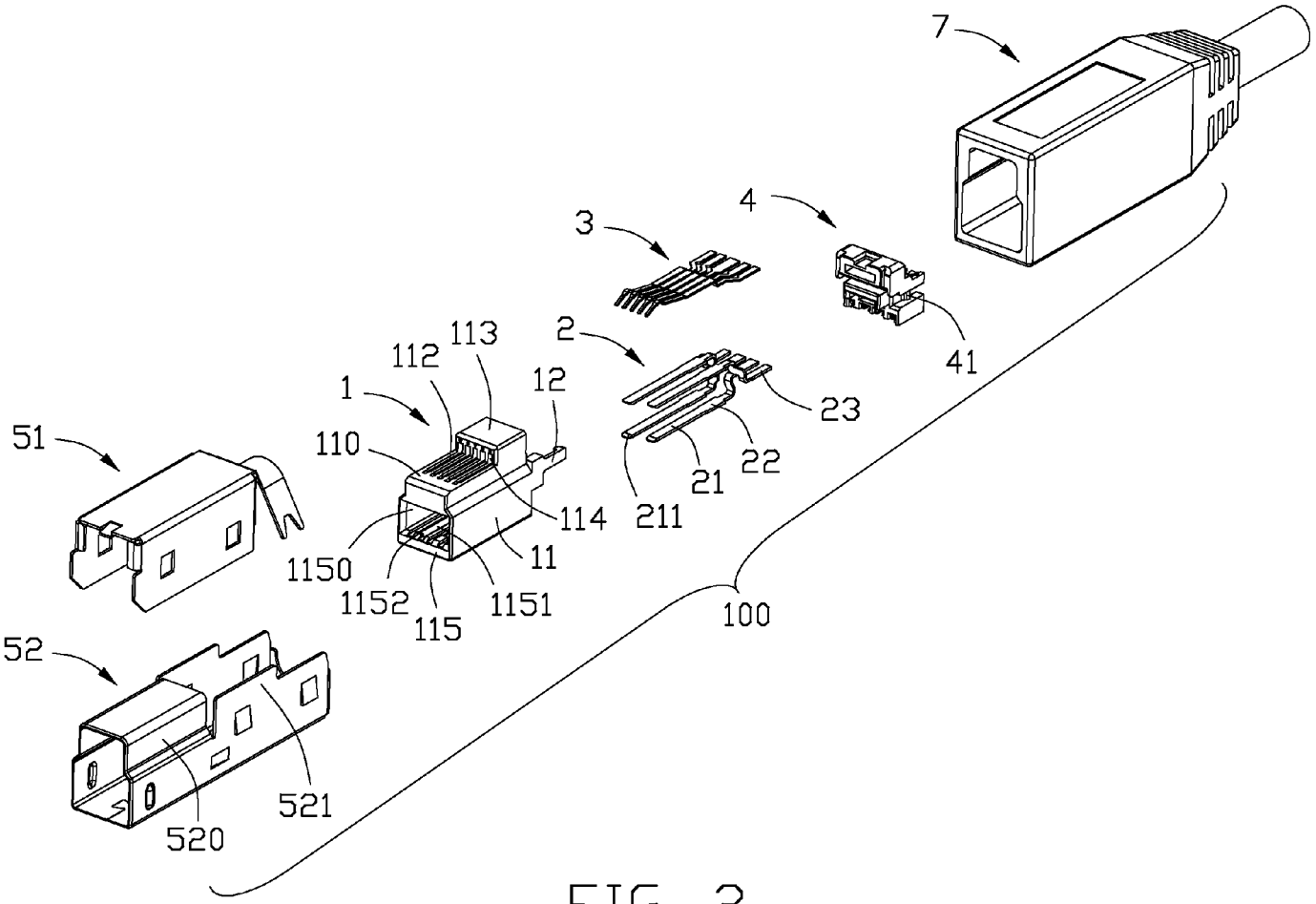
FIGS. 2-3 are exploded views of the cable connector assembly shown in FIG. 1.
Figure 3:
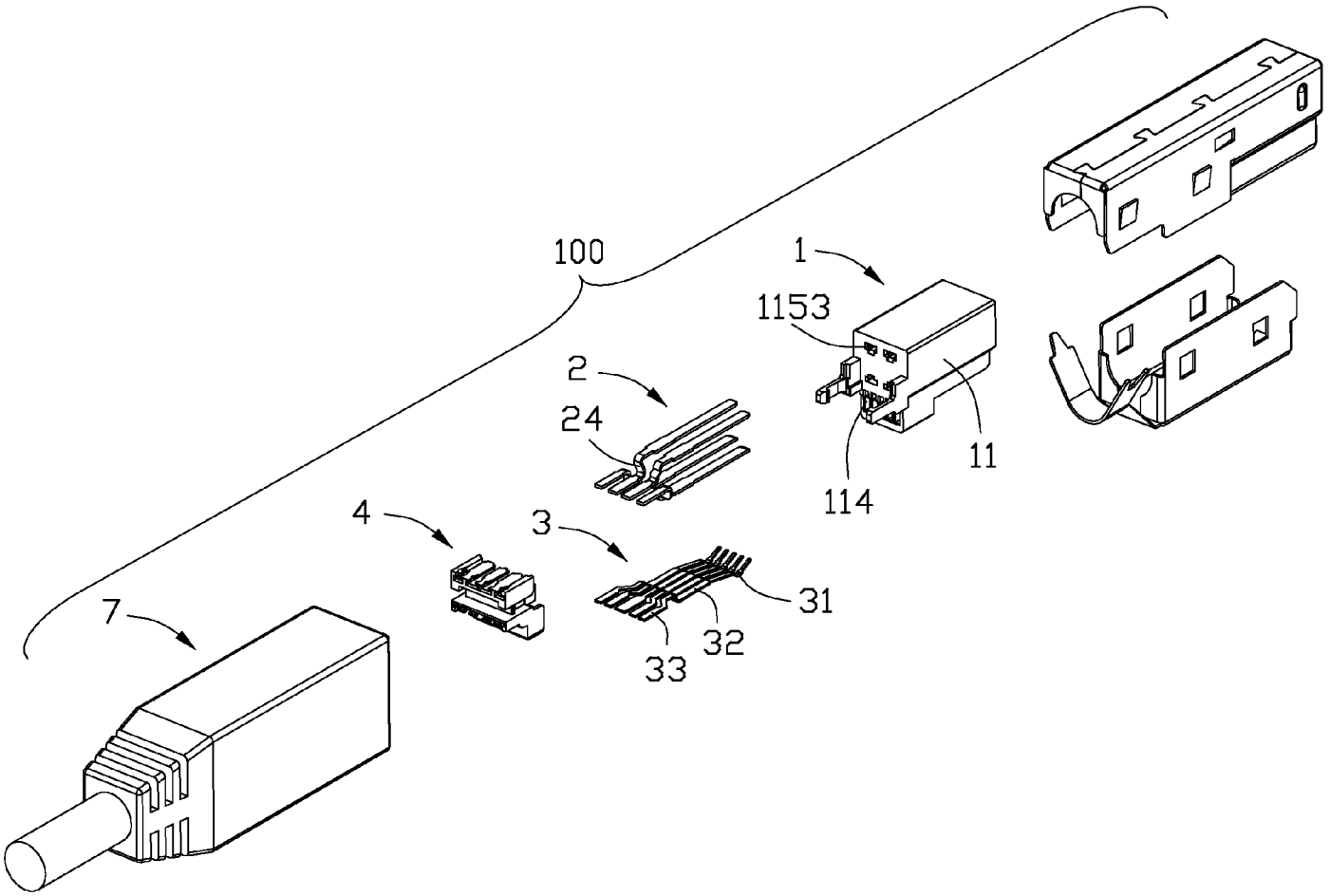
Figure 4:
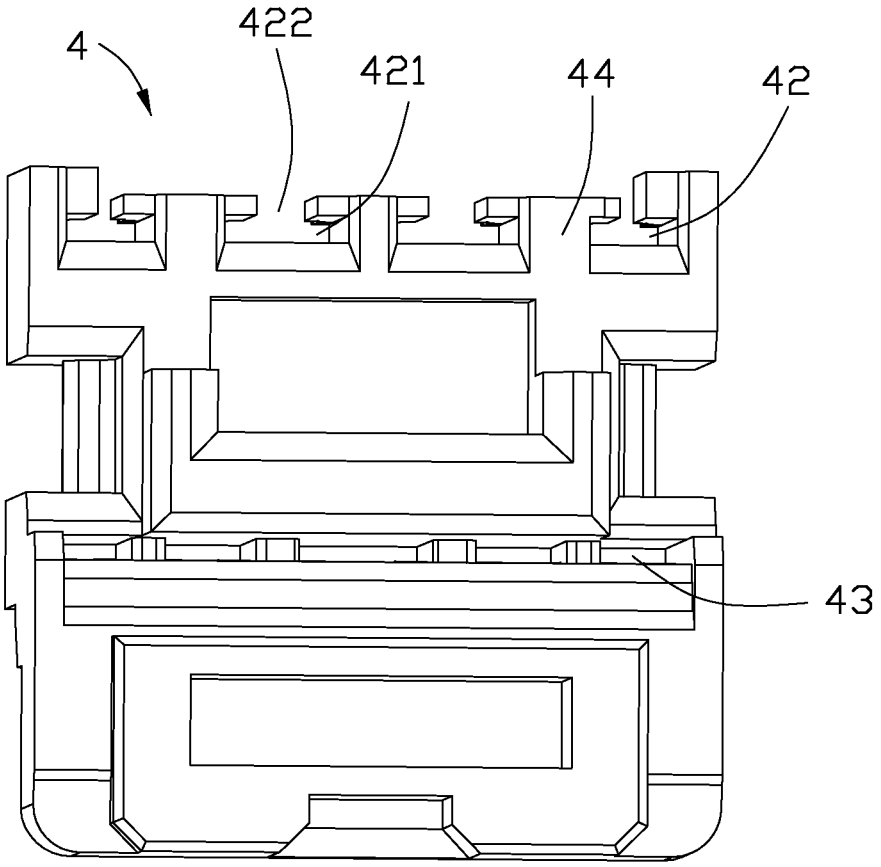
FIG. 4 is a perspective view of a spacer of the cable connector assembly shown in FIG. 2.

Referring to FIGS. 1-4, a cable connector assembly 100 according to the present invention is disclosed. The cable connector assembly 100 is a B-type USB 3.0 plug. The cable connector assembly 100 comprises an insulative housing 1, a plurality of first and second contacts 2, 3 retained in the insulative housing 1, a spacer 4 assembled to the insulative housing 1 for retaining the first and second contacts 2, 3, a metallic shell 5 enclosing on the insulative housing 1, a cable 6 including wires electrically connected with, e.g., soldered to the first and second contacts 2, 3, and a plastic case 7 surrounding on the metal shell 5.

Figure 5:
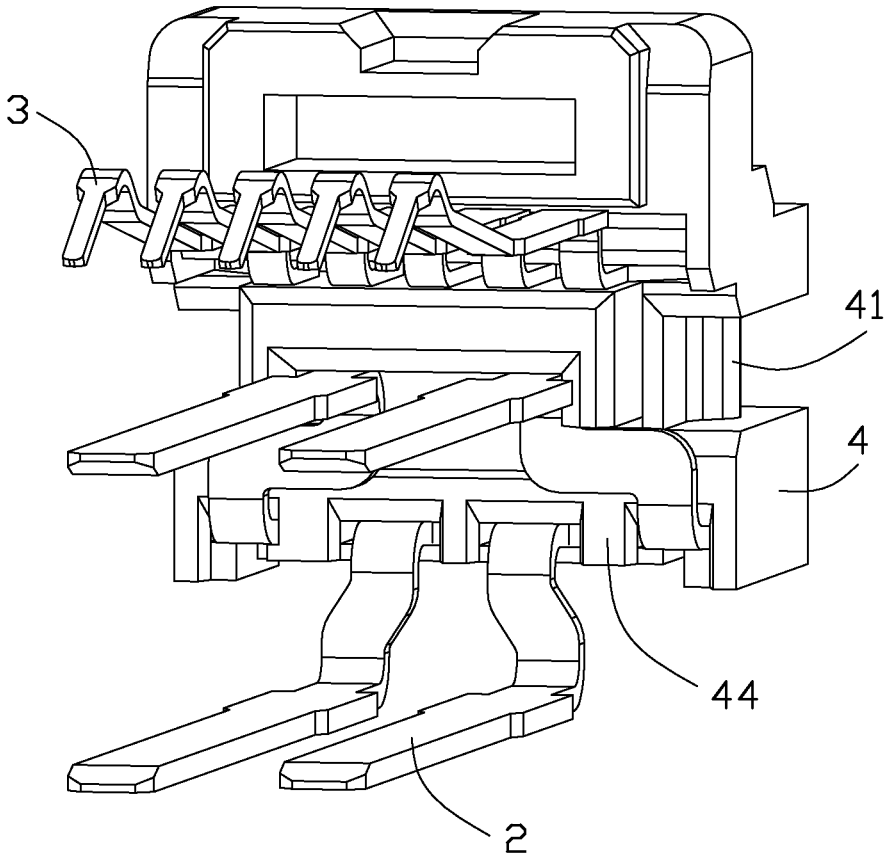
FIG. 5 is an assembled, perspective view of contacts inserted into the spacer of the cable connector assembly shown in FIG. 2.
Figure 6:
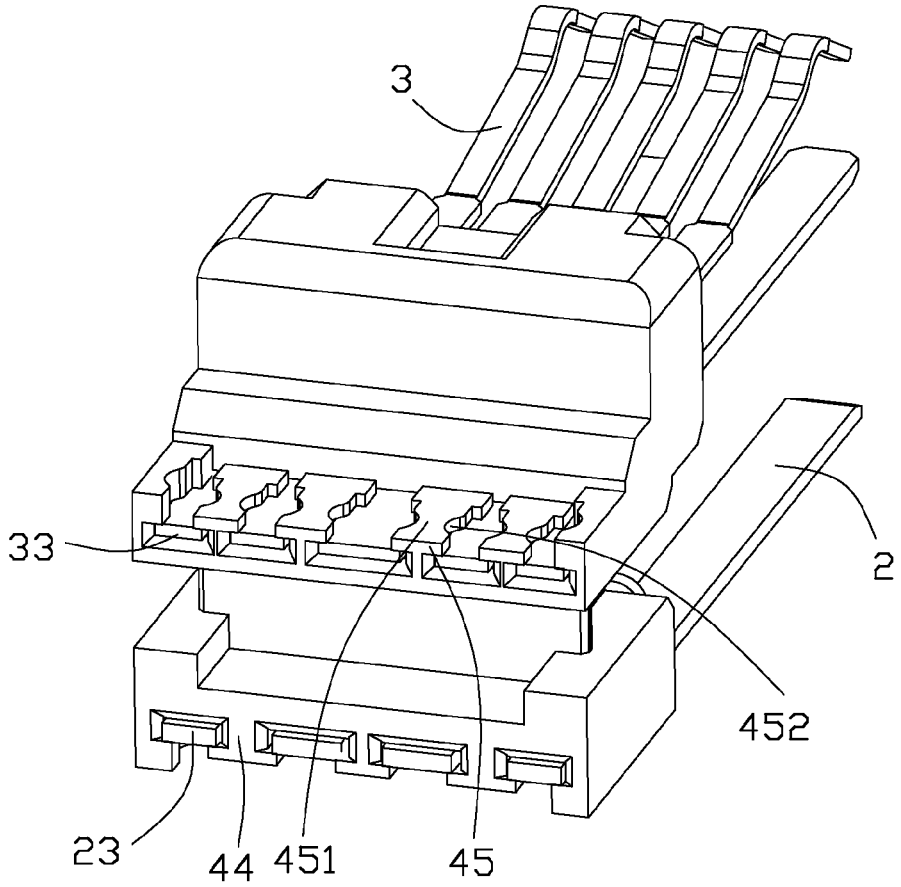
FIG. 6 is a view similar to FIG. 5, but viewed from another aspect.

Referring to FIGS. 2-6, the insulative housing 1 is molded of dielectric material such as plastic or the like, and comprises a main portion 11 and a pair of latch arms 12 extending backwards from lateral sides of the main portion 11. The main portion 11 defines a top surface 110, and five passages 112 are defined on the top surface 110. The main portion 11 has a projecting portion 113 on a back section thereof, the projecting portion 113 is extruding upwards from the top surface 110 of the main portion 11. The projecting portion 113 has five channels 114 communicated with corresponding passages 112. The main portion 11 has a front end surface 115, and a cavity 1150 is recessed backwards from the front end surface 115. A plurality of slots 1151 are arranged on an upper wall and a lower wall of the cavity 1150, and each slot 1151 defines a stopper 1152 therein, the stopper 1152 is neighboring to the front end surface 115. The main portion 11 also defines a plurality of through holes 1153 recessed forwardly from a back surface thereof, and the through holes 1153 are communicated with corresponding slots 1151.

The first contacts 2 are retained in the corresponding slots 1151 and adapted for B type USB 2.0 protocol, and each first contact 2 includes a flat contacting portion 21, a retaining portion 22 extending rearwards from the contacting portion 21 and a rear tail portion 23. The contacting portion 21 defines a slant tip portion on a front end thereof, and a bending portion 24 is connected with the retaining portion 22 and the tail portion 23. Four contacting portions 21 of the first contacts 2 are arranged on two different horizontal levels, and the four tail portions 23 of the first contacts 2 are located in a first row along a transverse direction. The first contacts 2 are exposed in the cavity 1150 and accommodated in the corresponding slots 1151 of the insulative housing 1.

The second contacts 3 are retained in the passages 112 of the insulative housing 1 for transmitting high sped signal, and include a first pair of differential contacts for transmitting high speed signal, a second pair of differential contacts for receiving high speed signal, and a grounding contact located between the first and second pairs of differential contacts for preventing cross-talk in high speed signal transmission. Each second contact 3 comprises a resilient contacting portion 31, a tail portion 33 and a connecting portion 32 connected the contacting portion 31 and the tail portion 33. The tail portions 33 of the second contacts 3 are arranged in a second row along the transverse direction.

The spacer 4 is assembled to a back end of the insulative housing 1, and has a pair of tabs 41 on both sides thereof to engage with corresponding latch arms 12 of the insulative housing 1. A plurality of first grooves 42 are defined on a bottom surface of the spacer 4 for receiving the tail portions 23 of the first contacts 2, and the first grooves 42 are communicated with an exterior in an up-to-down direction. A plurality of second grooves 43 are defined in a middle section of the spacer 4 in the up-to-down direction, and disposed in a horizontal row. A first separator 44 is defined between every two neighboring first grooves 42, and the first separator 44 is configured with T-shape, thus each first groove 42 is divided into two segments along the up-to-down direction, and the two segments of the first groove 42 have different width, the upper segment having a larger width is served as a contact receiving groove 421, the lower segment with a smaller width is served as a wire receiving groove 422, therefore the first contacts 2 are restricted by the first separator 44 for preventing being warped.

A second separator 45 is disposed between every two neighboring second grooves 43, in preferred embodiment of the invention, each second separator 45 has a similar cross-section view to the first separator 44 and is of T-shaped. In other embodiment of the invention, two side walls of the second separator 45 are symmetrical and of arc shaped. The spacing of lower section of every two neighboring second separator 45 is larger than a width of the second contact 3, and the spacing of upper section of every two neighboring second separator 45 is smaller than the width of the second contact 3. Each second separator 45 defines a board portion 451 on a top end thereof, and the board portion 451 is parallel to tail portions 33 of the second contacts 3, a pair of rounded breaches 452 being defined on lateral sides of the board portion 451 in order to be able to receive a coarse wire of the cable 6 while ensuring sufficient solder fillets on both sides of the wire.

The first contacts 2 and the second contacts 3 are assembled to the insulative housing 1, and the tail portions 23, 33 are extending beyond the back surface of the insualtive housing 1, then inserted into the corresponding first and second grooves 42, 43 of the spacer 4.

The metallic shell 5 is made of metallic material, and comprises a first shielding member 51 and a second shielding member 52 assembled each other along an up-to-down direction. The second shielding member 52 comprises a front tube portion 520 and a rear U-shaped extension portion 521 extending rearwards from the tube portion 520.

The cable 6 is electrically connected with the first contacts 2 and the second contacts 3.

The first contacts 2 are assembled to the slots 1151 of the insulative housing 1, and the second contacts 3 are inserted into the passages 112 of the insulative housing 1. The spacer 4 is assembled to the back surface of the insulative housing 1, and the latch arms 12 of the insulative housing 1 are cooperated with corresponding tabs 41 of the spacer 4 to combine the spacer 4 and the insulative housing 1. Then the insulative housing 1 is assembled to the second shielding member 52, a receiving space is formed by the top surface 110 of the insulative housing 1 and the second shielding member 52, and the receiving space is located above the cavity 1150, the second contacts 3 are accommodated in the receiving space with the first contacts 2 located in the cavity 1150. The first shielding member 51 is assembled to the second shielding member 52, and the plastic case 7 is molded on the metallic shell and the cable 6. Thus, the cable connector assembly 100 is assembled.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A cable connector assembly comprising:

an insulative housing, a plurality of first and second contacts held in the insulative housing, each of the first and second contacts having a contacting portion and a tail portion;

a cable electrically connected with the first and second contacts;

a spacer assembled to a back end of the insulative housing; and a metallic shell enclosing on the insulative housing; wherein:

the spacer defines a plurality of first grooves and second grooves, the tail portions of the first and second contacts extend beyond the back end of the insulative housing and received in corresponding first and second grooves, a T-shaped first separator is disposed between every two neighboring first grooves, and the tail portions of the first contacts are restrained by corresponding first separators;

a T-shaped second separator is disposed between every two neighboring second grooves, and the tail portions of the second contacts are restrained by corresponding T-shaped second separators;

each T-shaped second separator defines a board portion on a top end thereof, and the board portion is parallel to the tail portions of the second contacts, and a pair of rounded breaches are defined on lateral sides of each board portion to enable soldering of the cable to the second contacts.

2. A cable connector assembly comprising:

an insulative housing defining a mating face;

a plurality of contacts disposed in the housing with front contacting sections exposed upon the mating face and horizontal rear connecting sections located behind the housing in a front-to-back direction; and an insulative spacer attached behind the housing and defining a plurality of horizontal contact receiving grooves in a rear face thereof to receive the corresponding horizontal rear connecting sections, respectively, and further defining a plurality of wire receiving grooves communicating with and aligned with the corresponding contact receiving grooves, respectively, in a vertical direction perpendicular to said front-to-back direction; wherein a dimension of each of said wire receiving grooves in a transverse direction, which is perpendicular to both said front-to-back direction and said vertical direction, is smaller than that of the corresponding contact receiving groove so as to form a T-shaped cross-sectional separator between two neighboring associated contact receiving grooves and wire receiving grooves for not only retaining the rear connecting section of the corresponding contact in position in both the vertical direction and the transverse direction but also leave a space to restrain an inner conductor of a corresponding wire in the transverse direction for soldering upon the rear connecting section of the corresponding contact;

wherein the wire receiving groove defines a wider middle portion compared with opposite front and rear portions along said front-to-back direction.

3. A cable connector assembly comprising:

an insulative housing defining a mating face;

a plurality of contacts disposed in the housing with front contacting sections exposed upon the mating face and horizontal rear connecting sections located behind the housing in a front-to-back direction; and an insulative spacer attached behind the housing and defining a plurality of horizontal contact receiving grooves in a rear face thereof to receive the corresponding horizontal rear connecting sections, respectively, and further defining a plurality of wire receiving grooves communicating with and aligned with the corresponding contact receiving grooves, respectively, in a vertical direction perpendicular to said front-to-back direction; wherein a dimension of each of said wire receiving grooves in a transverse direction, which is perpendicular to both said front-to-back direction and said vertical direction, is smaller than that of the corresponding contact receiving groove so as to form a T-shaped cross-sectional separator between two neighboring associated contact receiving grooves and wire receiving grooves for not only retaining the rear connecting section of the corresponding contact in position in both the vertical direction and the transverse direction but also leave a space to restrain an inner conductor of a corresponding wire in the transverse direction for soldering upon the rear connecting section of the corresponding contact;

wherein a front portion of each of said wire receiving grooves is dimensioned to snugly hold said inner conductor of each wire.

* * * * *